US011988216B2

(12) United States Patent
Li

(10) Patent No.: US 11,988,216 B2
(45) Date of Patent: May 21, 2024

(54) BUILT-IN AIR PUMP WITH RAPID INFLATION AND DEFLATION

(71) Applicant: WangLi Plastic & Electronics (Huizhou) Co., Ltd.

(72) Inventor: Yonghe Li, Guangdong (CN)

(73) Assignee: WANGLI PLASTIC & ELECTRONICS (HUIZHOU) CO., LTD., Guangdong (CN)

( * ) Notice: Subject to any disclaimer, the term of this patent is extended or adjusted under 35 U.S.C. 154(b) by 0 days.

(21) Appl. No.: 17/964,473

(22) Filed: Oct. 12, 2022

(65) Prior Publication Data

US 2024/0026892 A1 Jan. 25, 2024

(30) Foreign Application Priority Data

Jul. 22, 2022 (CN) ..... 202210866449.0

(51) Int. Cl.

| | |
|---|---|
| ***F04D 25/08*** | (2006.01) |
| ***A47C 27/08*** | (2006.01) |
| ***F04D 17/10*** | (2006.01) |
| ***F04D 27/00*** | (2006.01) |
| ***F04D 29/50*** | (2006.01) |

(52) U.S. Cl.

CPC ..... *F04D 27/003* (2013.01); *A47C 27/082* (2013.01); *F04D 17/10* (2013.01); *F04D 25/084* (2013.01); *F04D 29/503* (2013.01)

(58) Field of Classification Search

CPC ..... F04D 25/084; F04D 25/08; F04D 25/10; F04D 29/48–503; A47C 27/082

See application file for complete search history.

(56) References Cited

U.S. PATENT DOCUMENTS 5,588,811 A * 12/1996 Price ..... F04B 27/10 417/350
5,606,756 A * 3/1997 Price ..... F04B 45/043 5/713
7,020,921 B2 * 4/2006 Wang ..... A47C 27/082 5/713
7,198,076 B2 * 4/2007 Wu ..... F04D 25/084 141/10

(Continued)

FOREIGN PATENT DOCUMENTS

CN 2779122 Y 5/2006
CN 203702615 U 7/2014

(Continued)

*Primary Examiner* — Justin D Seabe
*Assistant Examiner* — Behnoush Haghighian
(74) *Attorney, Agent, or Firm* — Muncy, Geissler, Olds & Lowe, P.C.

(57) ABSTRACT

A built-in air pump with rapid inflation and deflation for an inflatable product includes a first channel, a second channel and a centrifugal fan. A first air hole and a third air hole are formed in the first channel. A second air hole and a fourth air hole are formed in the second channel. The suction end of the centrifugal fan is abutted against the first channel, and the exhaust end of the centrifugal fan is abutted against the second channel. When in inflation, the first air hole and the second air hole are communicated with the outside of the inflatable product, and the third air hole and the fourth air hole are communicated with an inner cavity of the inflatable product.

15 Claims, 11 Drawing Sheets

(56) References Cited

U.S. PATENT DOCUMENTS

| | | | | |
|---|---|---|---|---|
| 7,210,902 | B2 * | 5/2007 | Song | F04D 29/503 415/206 |
| 10,786,089 | B2 * | 9/2020 | Lau | F04D 25/068 |
| 11,317,731 | B2 * | 5/2022 | Lau | F04D 29/403 |
| 11,401,926 | B2 * | 8/2022 | Huang | F04D 25/084 |
| 11,549,514 | B2 * | 1/2023 | Huang | F04D 25/12 |
| 2006/0065322 | A1 * | 3/2006 | Wu | F04D 29/503 141/67 |
| 2006/0073012 | A1 * | 4/2006 | Song | F04D 29/4213 415/206 |
| 2006/0085918 | A1 * | 4/2006 | Metzger | F04D 25/084 5/713 |
| 2006/0222535 | A1 * | 10/2006 | Liu | F04D 25/084 417/423.1 |
| 2015/0308454 | A1 * | 10/2015 | Shi | F04D 27/008 415/151 |
| 2020/0386235 | A1 * | 12/2020 | Huang | A47C 27/082 |
| 2021/0003126 | A1 * | 1/2021 | Huang | F04D 25/166 |
| 2022/0125214 | A1 * | 4/2022 | Lau | F04D 29/503 |
| 2023/0093808 | A1 * | 3/2023 | Huang | F04D 27/005 417/315 |

FOREIGN PATENT DOCUMENTS

| | | | |
|---|---|---|---|
| CN | 210423098 | U | 4/2020 |
| CN | 210799434 | U | 6/2020 |
| TW | M482371 | U | 7/2014 |

* cited by examiner

BUILT-IN AIR PUMP WITH RAPID INFLATION AND DEFLATION

CROSS REFERENCE TO RELATED APPLICATIONS

The present application claims priority from Chinese Patent Application No. 202210866449.0 filed on Jul. 22, 2022, all of which are hereby incorporated herein by reference.

TECHNICAL FIELD

The present invention relates to the technical field of air pumps, and particularly relates to a built-in air pump with rapid inflation and deflation for an inflatable product.

BACKGROUND

Currently, some inflatable products on the market are provided with an inflation air pump therein. The inflation air pump has an air inlet which can be opened during inflation for filling the inner cavity of the inflatable product with air. After inflation is completed, the air inlet is closed to prevent the air from leaking out. When it is desired to deflate the inflatable product, the air inside the inflatable product is automatically discharged.

However, in order to achieve inflation and deflation, the air pump disposed in the inflatable product generally includes an inflation channel and a deflation channel, which each communicates with a fan, so that inflation and deflation of the inflatable product can be achieved by the inflation channel and a deflation channel with the respective fan. Therefore, such air pump is often provided with two motors and two fans inside, which requires support elements to equip the motors and fans, and associated control circuit, causing complex internal structure of the air pump and higher production costs. In addition, with two fans and two motors, the whole volume of the air pump will become larger, resulting in larger mounting space in the inflatable product, such air pump thus cannot used in small inflatable products, which will limit application of the air pump.

In order to reduce the overall volume of the air pump, some improved air pumps have removed the deflection function, and only inflation function are remained. However, such way by reducing structure to lower the volume will undoubtedly affect use experience of the inflatable product, such as inconvenience in use.

SUMMARY

The present invention thus provides a built-in air pump with rapid inflation and deflation and an inflatable product with the same, which has inflation function and deflation function simultaneously, with simplified internal structure and lower production costs, and has lower overall volume of the air pump and lower transportation costs of the product accordingly.

According to the present invention, on one aspect, a built-in air pump with rapid inflation and deflation for an inflatable product is provided, which includes a first channel, a second channel and a centrifugal fan. A first air hole and a third air hole are formed in the first channel. A second air hole and a fourth air hole being formed in the second channel. A suction end of the centrifugal fan abuts against the first channel, and an exhaust end of the centrifugal fan abuts against the second channel.

When the built-in air pump is disposed in the inflatable product, the first air hole and the second air hole are externally communicated with the outside of the inflatable product, and the third air hole and the fourth air hole are internally communicated with an inner cavity of the inflatable product.

When inflation of the inflatable product is required, the centrifugal fan is started to operate, meanwhile the first air hole and the fourth air hole are opened and the second air hole and the third air hole are closed, so that the air outside the inflatable product is sucked into the first channel through the first air hole by the centrifugal fan, and further pushed to the second channel and delivered to the inner cavity of the inflatable product through the fourth air hole by the centrifugal fan. Once the inflation is completed, the first air hole and the second air hole are closed to prevent the air in the inflatable product from leaking to the outside.

When deflation of the inflatable product is required, the centrifugal fan is started to operate, meanwhile the third air hole and the second air hole are opened and the first air hole and the fourth air hole are closed, so that the air in the inner cavity of the inflatable product are sucked into the first channel through the third air hole by the centrifugal fan, and further pushed into the second channel and discharged to the outside through the second air hole by the centrifugal fan.

According to the present invention, only one fan and thus one associated motor are required to achieve inflation function and deflation function, and an associated control circuit required can also be more simplified, which results in simplified internal structure of the air pump and lower production costs of the air pump. Accordingly, the overall volume of the air pump is reduced, thus avoiding excessive mounting space in the inflatable product, which is better adaptable to small inflatable products.

On another aspect, an inflatable product with such built-in air pump is further provided.

BRIEF DESCRIPTION OF THE DRAWINGS

In order to more clearly explain the technical solution of the present invention, the accompanying drawings which are required to be used in the embodiments will be briefly introduced below.

DETAILED DESCRIPTION

The embodiments described below with reference to the accompanying drawings are exemplary, only used to explain the present invention, and cannot be construed as limiting the present invention.

Figure 1:
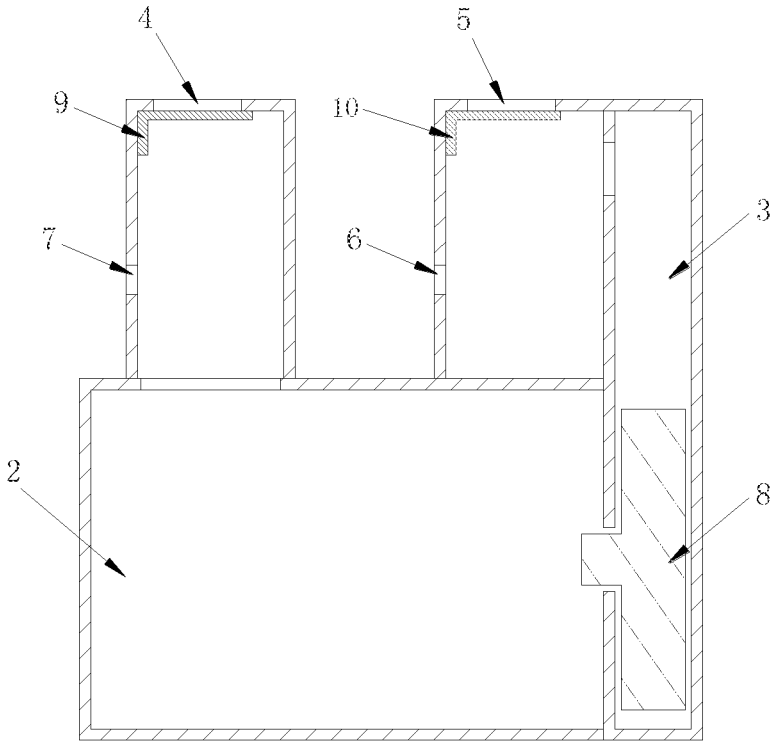
FIG. 1 is a schematic diagram of the working principle of the present invention.

A built-in air pump with rapid inflation and deflation is provided in FIG. 1, which includes a first channel 2, a second channel 3 and a centrifugal fan 8. A first air hole 4 and a third air hole 7 are formed in the first channel 2. A second air hole 5 and a fourth air hole 6 are formed in the second channel 3. A suction end of the centrifugal fan 8 abuts against the first channel 2, and an exhaust end of the centrifugal fan 8 abuts against the second channel 3.

Figure 2:
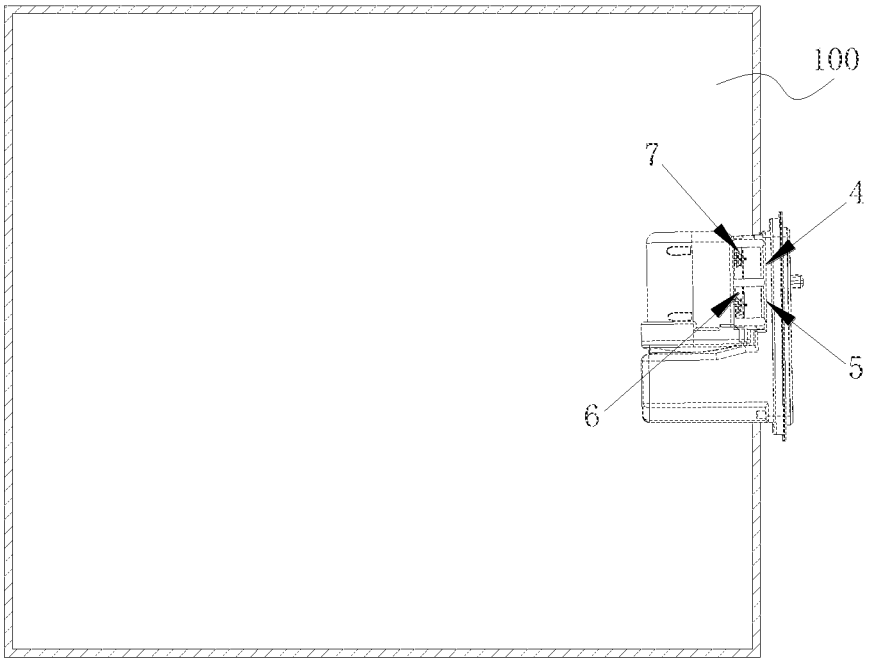
FIG. 2 is a structural schematic diagram when a built-in air pump of the present invention is assembled in an inflatable product.

Referring to FIG. 2, when the built-in air pump is disposed in an inflatable product 100, the first air hole 4 and the second air hole 5 externally communicates with the outside of the inflatable product 100, so that outside air can enter an air pump though the first air hole 4, and the air in the air pump can also be discharged to the outside through the second air hole 5. The third air hole 7 and the fourth air hole 6 internally communicates with an inner cavity of the inflatable product 100, so that the air in the air pump can enter the inner cavity of the inflatable product 100 through the fourth air hole 6, and the air in the inner cavity of the inflatable product 100 can also enter the air pump from the third air hole 7.

Figure 3:
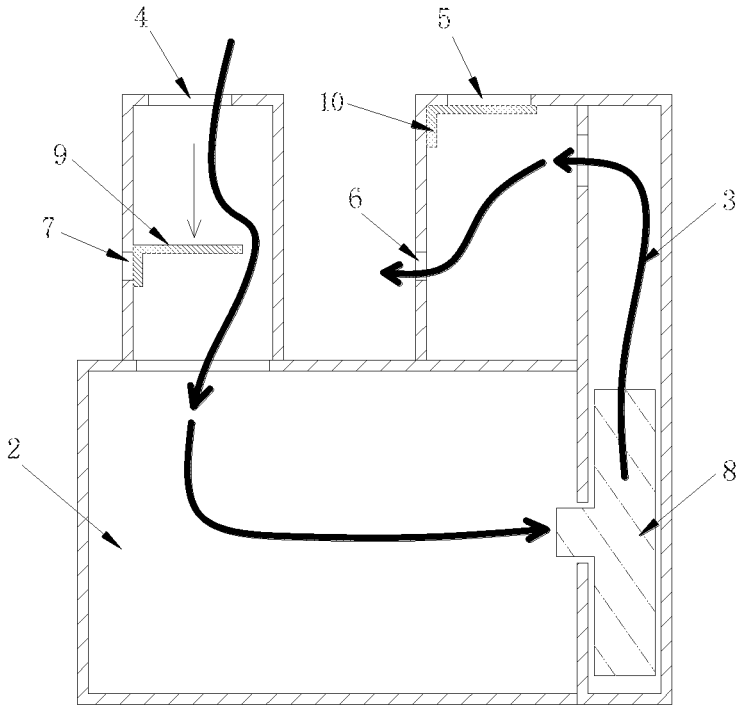
FIG. 3 is another schematic diagram of the working principle of the present invention.

In combination with FIGS. 1-3, when inflation is required, the centrifugal fan 8 is started to operate, meanwhile the first air hole 4 and the fourth air hole 6 are opened and the second air hole 5 and the third air hole 7 are closed, the air outside is sucked into the first channel 2 through the first air hole 4 by the centrifugal fan 8, then the air is pushed to the second channel 3 and further delivered to the inner cavity of the inflatable product 100 through the fourth air hole 6 by the centrifugal fan 8. As shown in FIG. 1, when inflation is completed, the first air hole 4 and the second air hole 5 are turned off to prevent the air from leaking to the outside.

Figure 4:
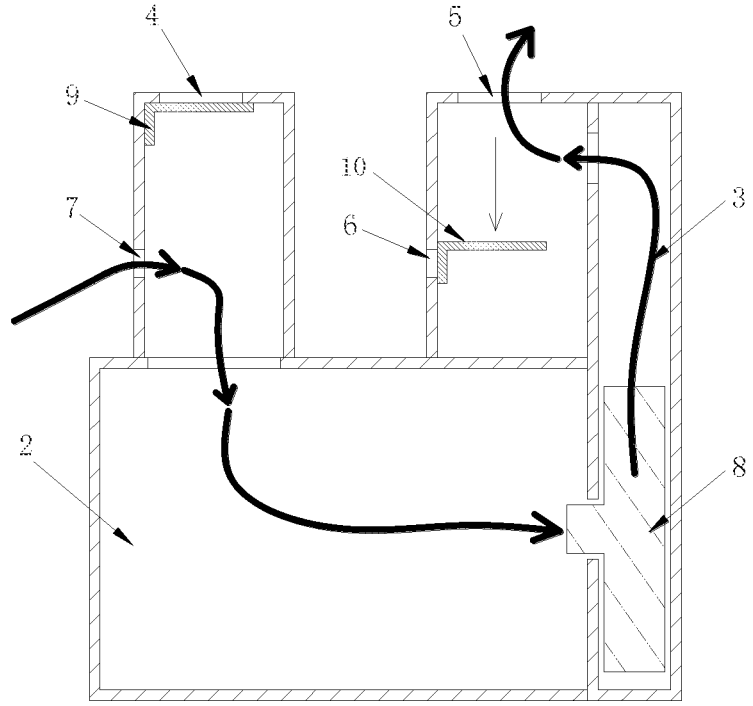
FIG. 4 is another schematic diagram of the working principle of the present invention.

In combination with FIGS. 1, 2 and 4, when deflation is required, the centrifugal fan 8 is started to operate, meanwhile the third air hole 7 and the second air hole 5 are opened and the first air hole 4 and the fourth air hole 6 are closed, the air in the inner cavity of the inflatable product 100 is sucked into the first channel 2 through the third air hole 7 by the centrifugal fan 8, then the air is pushed into the second channel 3 and discharged to the outside through the second air hole 5 by the centrifugal fan 8.

Specifically, as shown in FIGS. 5-9, the built-in air pump has a housing 1. The first channel 2 and the second channel 3 are spaced in the housing 1. The first air hole 4, the second air hole 5, the fourth air hole 6 and the third air hole 7 are respectively formed on the housing 1 in a way that the first air hole 4 and the third air hole 7 respectively communicate with the first channel 2, and the second air hole 5 and the fourth air hole 6 respectively communicate with the second channel 3.

According to one embodiment, on the one hand, the interior of the housing 1 of the air pump is divided to form the first channel 2 and the second channel 3, the centrifugal fan 8 is mounted in the housing 1 in a way that the exhaust end of the centrifugal fan 8 is placed in the second channel 3, and the suction end of the centrifugal fan 8 is placed in the first channel 2. On the other hand, the first air hole 4, the second air hole 5, the fourth air hole 6 and the third air hole 7 are respectively formed on the housing 1. When the air pump is mounted on the inflatable product 100, the first air hole 4 and the second air hole 5 respectively communicate with the outside of the inflatable product 100, so that the air outside the inflatable product can enter the air pump through the first air hole 4, and the air inside the air pump can also be discharged outward through the second air hole 5 to the outside; and the fourth air hole 6 and the third air hole 7 respectively communicate with the inner cavity of the inflatable product 100, so that the air pump can inflate the inner cavity of the inflatable product 100 through the fourth air hole 6 to achieve inflation, and the air in the inner cavity of the inflatable product 100 can also be sucked out through the third air hole 7 to achieve deflation effect.

When inflation is required, the centrifugal fan 8 is started to operate, meanwhile the first air hole 4 and the fourth air hole 6 are opened and the second air hole 5 and the third air hole 7 are closed, the air outside is sucked into the first channel 2 through the first air hole 4 by the centrifugal fan 8, then the air is pushed to the second channel 3 and delivered to the inner cavity of the inflatable product 100 through the fourth air hole 6 the centrifugal fan 8. After inflation is completed, the first air hole 4 and the second air hole 5 are closed to prevent the air from leaking to the outside. When deflation is required, the centrifugal fan 8 is started to operate, meanwhile the third air hole 7 and the second air hole 5 are opened and the first air hole 4 and the fourth air hole 6 are closed, the air in the inner cavity of the inflatable product is sucked into the first channel 2 through the third air hole 7 by the centrifugal fan 8, then the air is pushed into the second channel 3 and discharged to the outside through the second air hole 5 by the centrifugal fan 8.

Therefore, with such configuration, only one fan and one associated motor is required to achieve inflation function and deflation function, and an associated control circuit required can also be more simplified, resulting in simplified internal structure of the air pump and lower production costs of the air pump. Accordingly, the overall volume of the air pump is reduced, thus avoiding excessive mounting space in the inflatable product, which is better adaptable to small inflatable products.

According to one embodiment, a control mechanism and a valve mechanism are further included. The movable valves in the valve mechanism are respectively controlled by the control mechanism, so that each movable valve in the valve mechanism is respectively controlled by the control mechanism to open or close the first air hole 4, the second air hole 5, the third air hole 7 and the fourth air hole 6. The first air hole 4, the second air hole 5, the third air hole 7, and the fourth air hole 6 thus can be opened or closed in cooperation with each other during inflation and deflation. As shown in FIGS. 1-9, in this embodiment, the valve mechanism includes a first movable valve 9 and a second movable valve 10, which are mounted in the housing 1. The first air hole 4 and the third air hole 7 can be alternately closed by the reciprocating movement of the first movable valve 9, and the second air hole 5 and the fourth air hole 6 can be alternately closed by the reciprocating movement of the second movable valve 10.

According to this embodiment, the first movable valve 9 and the second movable valve 10 are respectively mounted in the housing 1 of the air pump, in a way that the first air hole 4 and the third air hole 7 can be alternately closed by the back-and-forth reciprocating movement of the first movable valve 9 (namely, when the first movable valve 9 moves to the first air hole 4, the first air hole 4 is closed and the third air hole 7 is in an open state, conversely, when the first movable valve 9 moves to the third air hole 7, the third air hole 7 is closed and the first air hole 4 is in an open state), and the second air hole 5 and the fourth air hole 6 can be alternately closed by the back-and-forth reciprocating movement of the second movable valve 10 (namely, when the second movable valve 10 moves to the second air hole 5, the second air hole 5 is closed and the fourth air hole 6 is in an open state, conversely, when the second movable valve 10 moves to the fourth air hole 6, the fourth air hole 6 is closed and the second air hole 5 is in an open state).

With such configuration, referring to FIGS. 5-9 and in combination with FIG. 3, when the inflation of the inflatable product 100 is required, the first movable valve 9 can be controlled to close the third air hole 7 (the first air hole 4 is in the open state at this moment), and the second movable valve 10 can be controlled to close the second air hole 5 at the same time (the fourth air hole 6 is in the open state at this moment). After the centrifugal fan 8 rotates, under the suction of the suction end of the centrifugal fan 8, the air outside can enter the first channel 2 through the first air hole 4, and at the same time, under the pushing of the exhaust end of the centrifugal fan 8, the air entering the first channel 2 can be pushed into the second channel 3, and as airflow flows, the air in the second channel 3 can continuously enter the inner cavity of the inflatable product 100 through the fourth air hole 6, thus achieving inflation.

With reference to FIGS. 5-9 and in combination with FIG. 1, when inflation is completed, the first movable valve 9 and the second movable valve 10 are controlled to close the first air hole 4 and the second air hole 5 respectively, so that the first channel 2 and the second channel 3 inside the air pump cannot communicate with the outside, the whole air pump is in a closed state, thereby ensuring that gas in the inner cavity of the inflatable product cannot leak to the outside, the inflatable product 100 thus can be maintained in an inflated state.

Conversely, with reference to FIGS. 5-9 and in combination with FIG. 4, when deflation is required, the first movable valve 9 can be controlled to close the first air hole 4 (the third air hole 7 is in the open state at this moment), and the second movable valve 10 can be controlled to close the fourth air hole 6 at the same time (the second air hole 5 is in the open state at this moment). After the centrifugal fan 8 rotates, under the suction of the suction end of the centrifugal fan 8, the air in the inner cavity of the inflatable product can enter the first channel 2 inside the air pump through the third air hole 7, and at the same time, under the pushing of the exhaust end of the centrifugal fan 8, the air entering the first channel 2 can be pushed to the second channel 3, and as the airflow flows, the air in the second channel 3 can be discharged to the outside through the second air hole 5, thus achieving the deflation effect.

Figure 10:
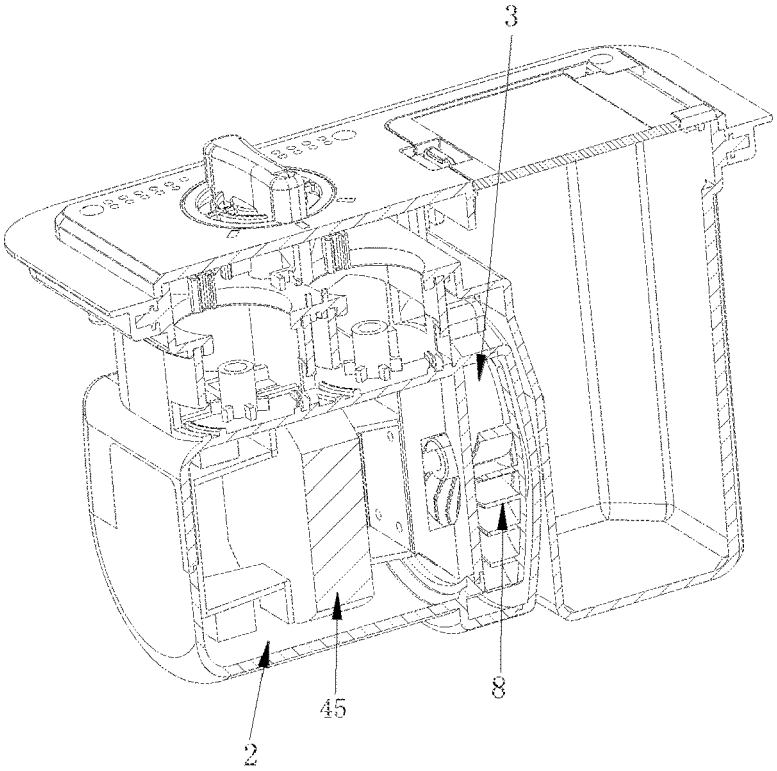
FIG. 10 is a partial schematic diagram of an internal structure of the present invention.

According to one embodiment, as shown in FIG. 10, a rotating motor 45 providing power for the centrifugal fan 8 may be mounted in the first channel 2 to make full use of the inner space of the air pump device, resulting in more compact inner structure of the air pump device.

According to one embodiment, as shown in FIGS. 1-9, the housing 1 includes an outer housing 18 and an inner housing 19, which are detachably connected to each other. When the air pump is disposed in the inflatable product 100, the outer housing 18 is correspondingly on the outer side of the inflatable product 100, and the inner housing 19 is correspondingly on the inner cavity of the inflatable product 100. The first air hole 4 and the second air hole 5 are respectively formed in the outer housing 18 and communicate with the outside of the inflatable product 100 via the outer housing 18. While the fourth air hole 6 and the third air hole 7 are respectively formed in the inner housing 19 and communicate with the inner cavity of the inflatable product 100 via the inner housing 19.

Figure 5:
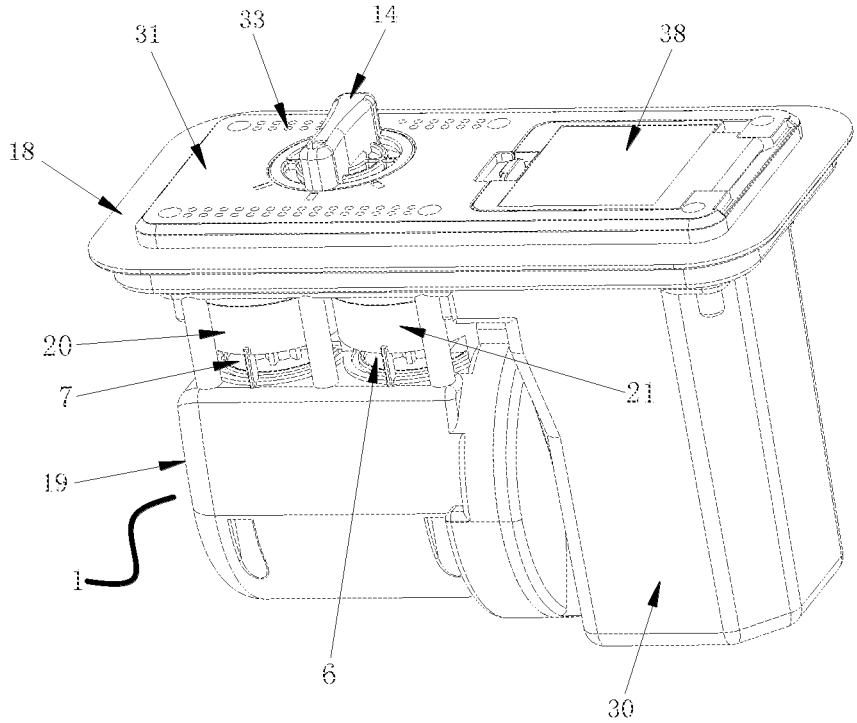
FIG. 5 is a schematic diagram of an overall structure of the present invention.
Figure 6:
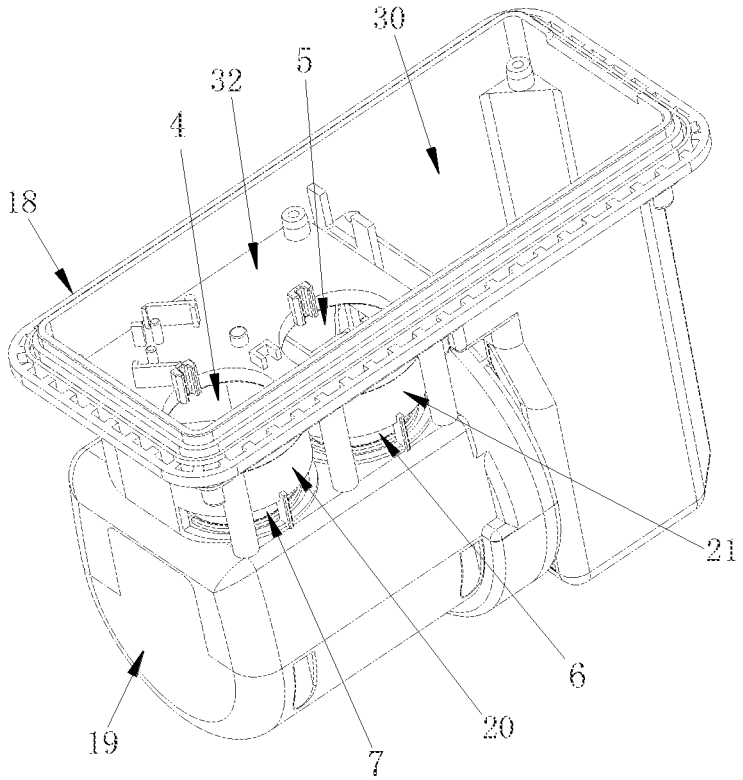
FIG. 6 is a schematic diagram of a partial structure of the present invention.

As shown in FIG. 5 and FIG. 6, the outer surface of the outer housing 18 is provided with a panel 31, and a cavity 32 is formed in the outer housing 18. The panel 31 is fixedly spliced on a top opening of the cavity 32. A plurality of through holes 33 are arranged in the surface of the panel 31. The first air hole 4 and the second air hole 5 are formed at the bottom of the cavity 32 and communicate with the cavity 32, so that the first air hole 4 and the second air hole 5 communicate with each through hole 33 in the panel 31 via the cavity 32. The air outside thus can enter the cavity 32 through each through hole 33 and continue to enter the first air hole 4, and the air discharged outward from the second air hole 5 can firstly enter the cavity 32 and then is discharged to the outside through each through holes 33. With such easy way, the inside of the air pump can be in communication with the outside.

According to one embodiment, an elastic mechanism is connected with the valve mechanism in a transmission mode, so that the valve mechanism can be driven by the elastic force of the elastic mechanism to keep the first air hole 4 and the second air hole 5 closed respectively, air in the inner cavity of the inflatable product 100 thus can be prevented from leaking, making the inflatable product 100 in an expanded state.

Figure 7:
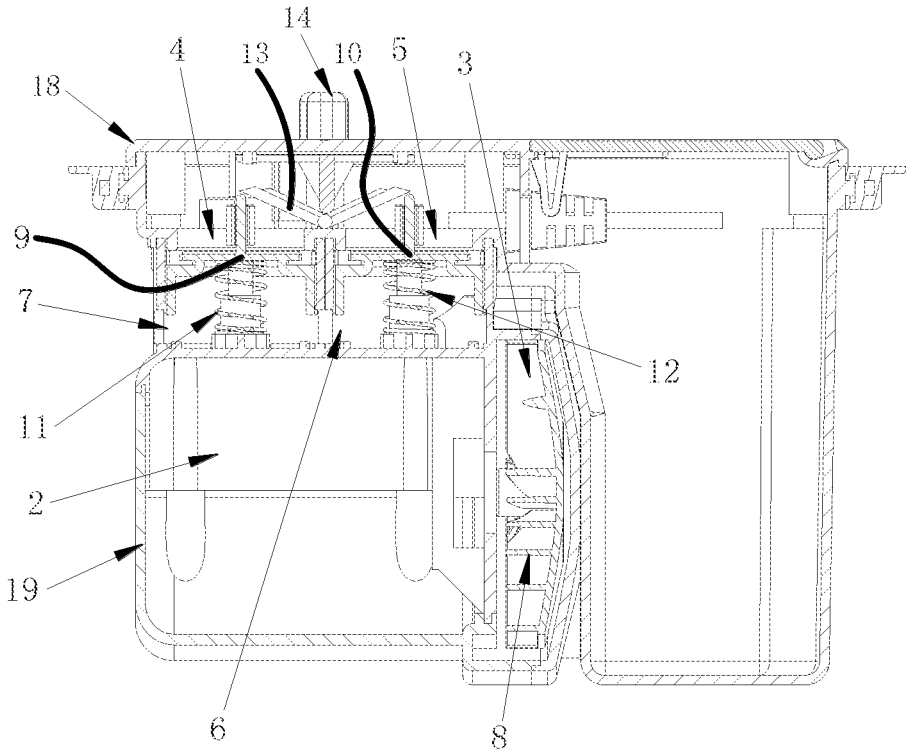
FIG. 7 is an overall schematic diagram of an internal structure of the present invention.
Figure 8:
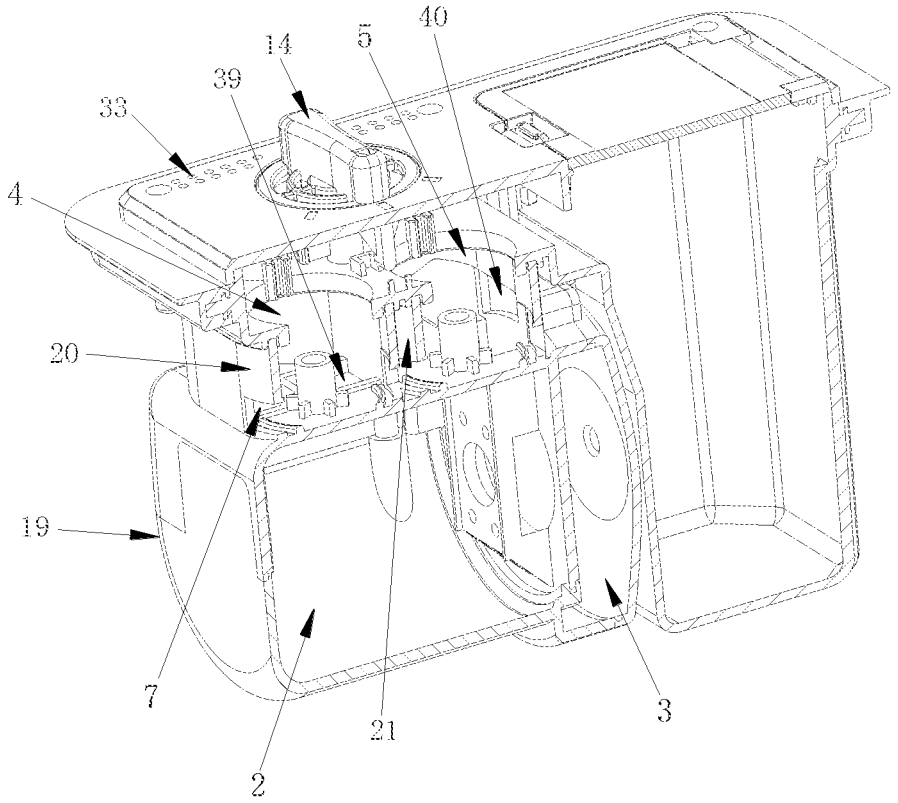
FIG. 8 is a partial schematic diagram of an internal structure of the present invention.
Figure 9:
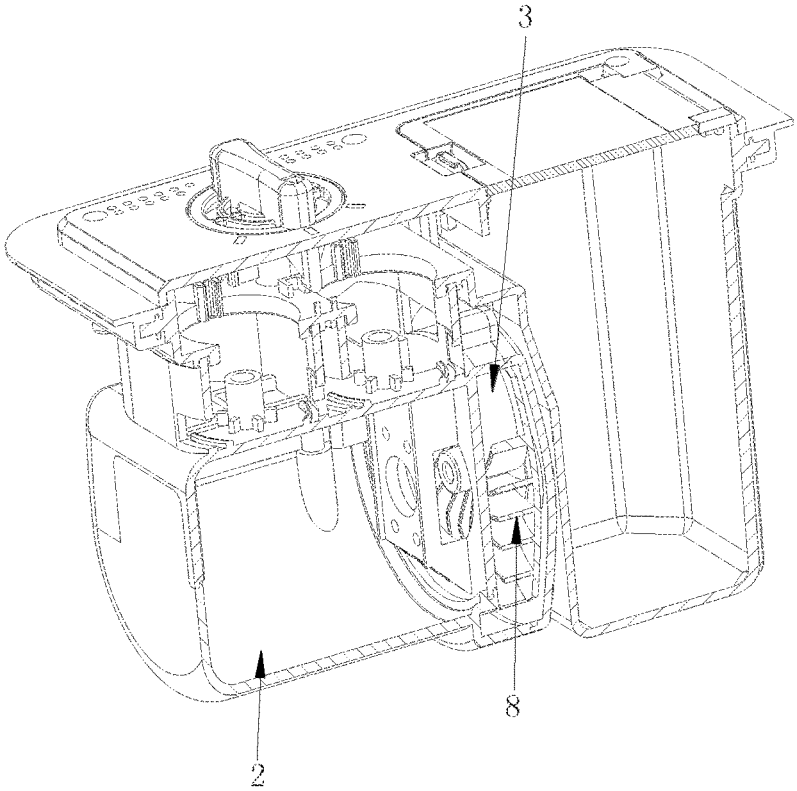
FIG. 9 is a partial schematic diagram of an internal structure of the present invention.

As shown in FIG. 7, the elastic mechanism includes a first spring 11 and a second spring 12. The first spring 11 is mounted on the first movable valve 9, and the second spring 12 is mounted on the second movable valve 10. The first movable valve 9 is driven to keep the first air hole 4 closed by the elastic force of the first spring 11, and the second movable valve 10 is driven to keep the second air hole 5 closed by the elastic force of the second spring 12.

It can be understood that the first movable valve 9 and the second movable valve 10 can be urged to respectively keep the first air hole 4 and the second air hole 5 closed with the elastic pushing force of the first spring 11 and the second spring 12, so that the first air hole 4 and the second air hole 5 can be kept in a normally closed state. Especially when inflation of the air pump device is finished, the first spring 11 can be reset to push the first movable valve 9 back to the original position as long as the controlling force on the first movable valve 9 is released, so that the first air hole 4 is re-closed, preventing the air in the inner cavity of the inflatable product 100 from leaking out, and maintaining the expanded state of the inflatable product 100.

A rotating body 13 is connected between the control mechanism and the valve mechanism in a transmission mode. The rotating body 13 is driven by the control mechanism to rotate forward and reverse, the first movable valve 9 and the second movable valve 10 are in turn respectively driven by the forward and reverse rotation of the rotating body 13 to move. With such easy way, the first movable valve 9 and the second movable valve 10 can be respectively controlled to move with the rotating body 13, which is simple in structure and easy in operation.

Figure 11:
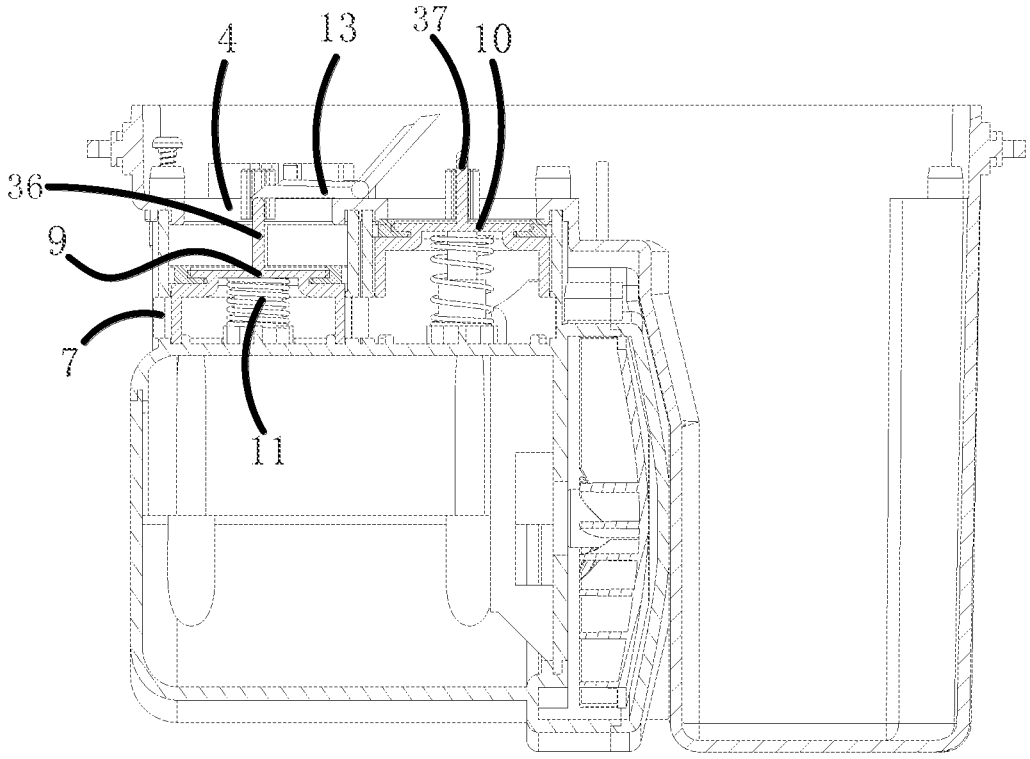
FIG. 11 is a schematic diagram of an internal structure of the present invention.
Figure 12:
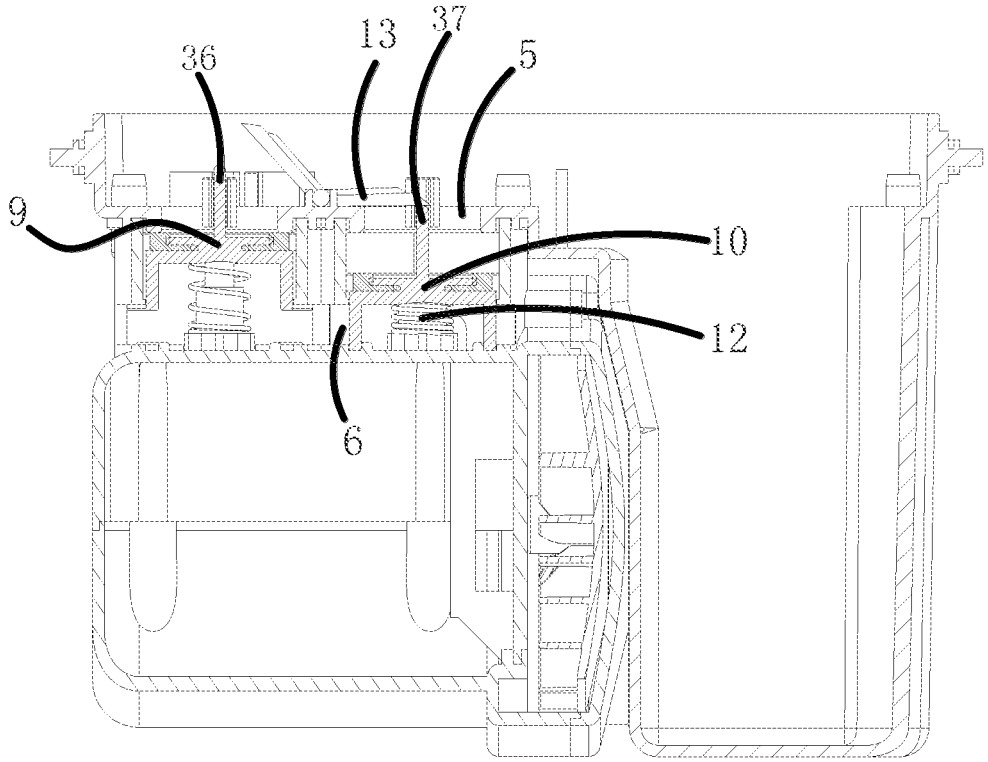
FIG. 12 is a schematic diagram of an internal structure of the present invention.
Figure 13:
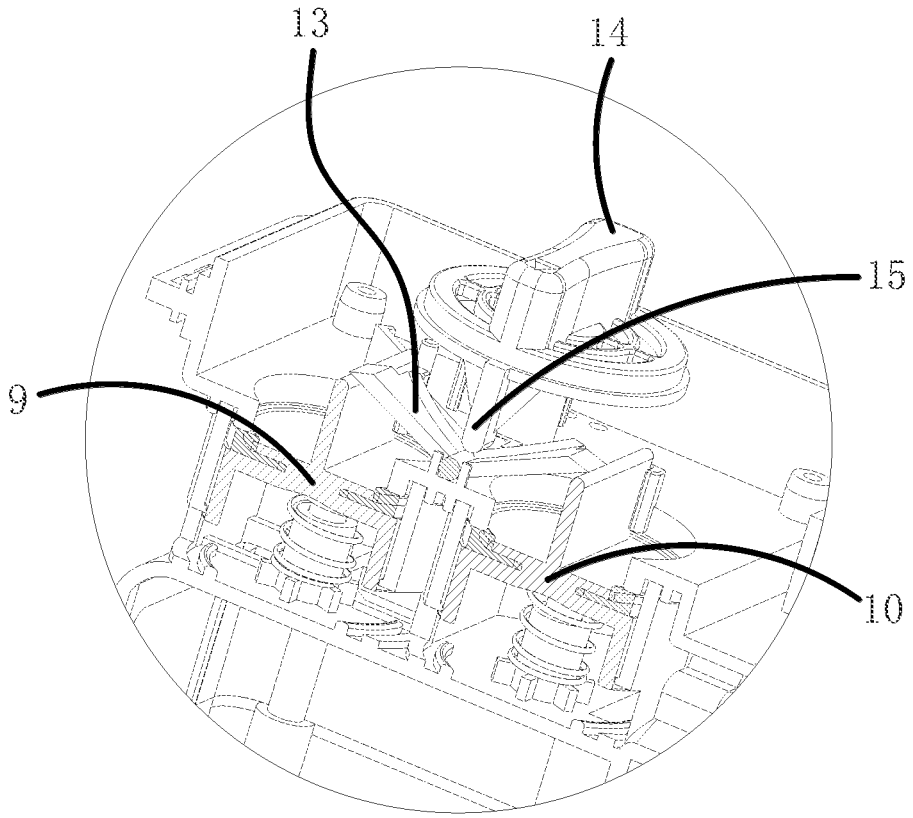
FIG. 13 is a partial schematic diagram of an internal structure of the present invention.

According to one embodiment, as shown in FIGS. 7, 11, and 12, the rotating body 13 is mounted in the outer housing 18, the first movable valve 9 and the second movable valve 10 are symmetrically distributed on two opposite sides of the rotating body 13, and the first movable valve 9 and the second movable valve 10 respectively abut against the rotating body 13 in a transmission mode, so that linkage can be formed between the rotating body 13 and the first movable valve 9, as well as between the rotating body 13 and the second movable valve 10. According to the present embodiment, the first movable valve 9 and the second movable valve 10 are alternatively driven to overcome the elastic force to move by the forward and reverse rotation of the rotating body 13.

Specifically, as shown in FIG. 11, when the rotating body 13 rotates counterclockwise, the first movable valve 9 can be driven to overcome the elastic force of the first spring 11 to move. Conversely, as shown in FIG. 12, when the rotating body 13 rotates clockwise, the second movable valve 10 can be driven to overcome the spring acting force of the second spring 12 to move. As shown in FIG. 11, when the first movable valve 9 overcomes the elastic force of the first spring 11 to move, the first movable valve 9 will open the first air hole 4 and close the third air hole 7 at the same time. Similarly, as shown in FIG. 12, when the second movable valve 10 overcomes the spring acting force of the second spring 12 to move, the second movable valve 10 will open the second air hole 5 and close the fourth air hole 6 at the same time.

With such configuration, the first movable valve 9 and the second movable valve 10 can be driven to move by overcoming the elastic force by controlling the forward and reverse rotation of the rotating body 13 alternatively, that is, the first movable valve 9 and the second movable valve 10 can be selectively driven as long as the rotation direction of the rotating body 13 is controlled, thus achieving the inflation and deflation of the air pump device with convenient operation. When rotating body 13 is stopped to be controlled, the rotating body 13 will not continue to push the first movable valve 9 and the second movable valve 10, and at this moment, the first spring 11 and the second spring 12 thus can push the first movable valve 9 and the second movable valve 10 to conduct reset movement, the first air hole 4 and the second air hole 5 thus will be re-closed. Therefore, with such configuration, the reciprocating movement of the first movable valve 9 can be easily achieved (realizing that the first movable valve 9 closes the first air hole 4 and the third air hole 7 alternately by the reciprocating movement) and the reciprocating movement of the second movable valve 10 can be achieved (realizing that the second movable valve 10 closes the second air hole 5 and the fourth air hole 6 alternately by the reciprocating movement), thus achieving inflation and deflation of the air pump device.

According to one embodiment, the control mechanism includes a knob switch 14 and a shifting lever 15. The shifting lever 15 is arranged on the knob switch 14 and can rotate with the knob switch 14, and the shifting lever 15 can shift the rotating body 13 to conduct forward and reverse rotation with the knob switch 14. Therefore, the rotating body 13 can be driven to generate forward and reverse rotation by controlling the knob switch 14 during operation.

As shown in FIGS. 5, 7, 8, and 13-16, the knob switch 14 is mounted on the outer housing 18, and the shifting lever 15 is fixed to the outer edge of the bottom of the knob switch 14 The rotating body 13 includes a central rotating shaft 16 and a butterfly plate 17 which can also be in a V shape. The central rotating shaft 16 may be integrally formed at the center of rotation of the butterfly plate 17, and the shifting lever 15 extends outwards to the inner side of the butterfly plate 17. In combination with FIGS. 13-16, when the shifting lever 15 swings from the center of the inner side of the butterfly plate 17 to the outer end of the butterfly plate 17, the shifting lever 15 synchronously shifts the butterfly plate 17 to deflect around the central rotating shaft 16. As the first movable valve 9 and the second movable valve 10 are symmetrically distributed on two opposite sides of the central rotating shaft 16 and respectively abut against the outer side of the butterfly plate 17 in a transmission mode, when the knob switch 14 is controlled to rotate, the shifting lever 15 is driven to swing back and forth by the forward and reverse rotation of the knob switch 14, and the butterfly plate 17 is in turn shifted to generate forward and reverse rotation by the back-and-forth swing of the shifting lever 15, so that the first movable valve 9 and the second movable valve 10 can be respectively driven to overcome the elastic force to move alternatively by the forward and reverse rotation generated by the butterfly plate 17.

Figure 14:
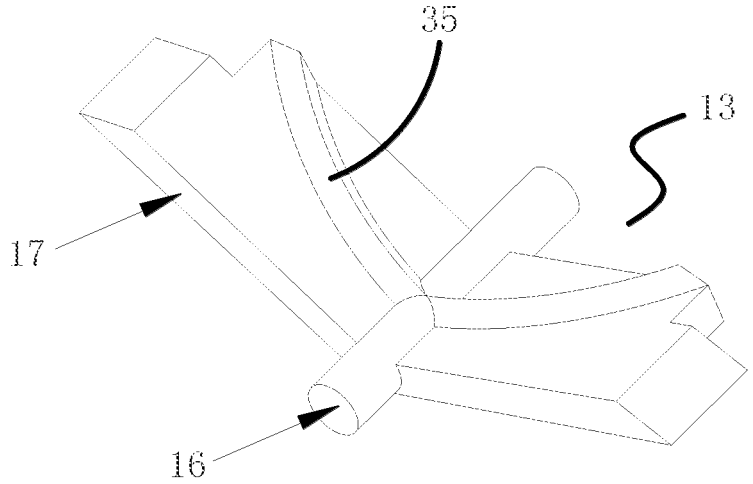
FIG. 14 is a schematic diagram of a partial structure of the present invention.
Figure 15:
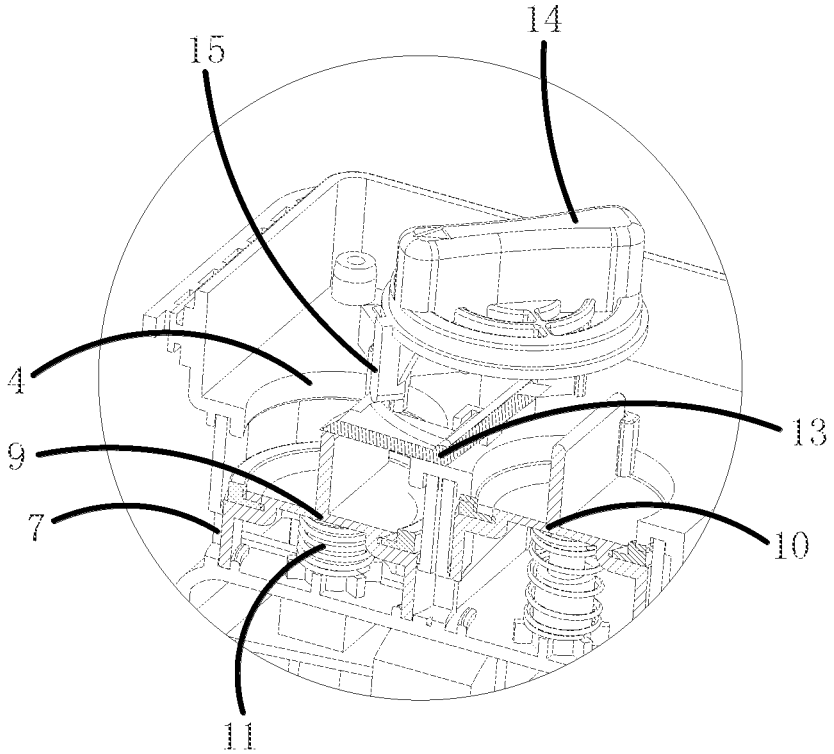
FIG. 15 is a schematic diagram of an internal structure of the present invention.

That is to say, in the present embodiment, referring to FIG. 14 and FIG. 15, when the knob switch 14 is controlled to rotate clockwise, the knob switch 14 synchronously drives the shifting lever to shift the butterfly plate 17 to deflect counterclockwise, and the counterclockwise deflected butterfly plate 17 drives the first movable valve 9 downwards against the first spring 11, causing the first movable valve 9 to move. Conversely, referring to FIG. 14 and FIG. 16, when the knob switch 14 is controlled to rotate counterclockwise, the knob switch 14 synchronously drives the shifting lever to shift the butterfly plate 17 to deflect clockwise, and the clockwise deflected butterfly plate 17 drives the second movable valve 10 downwards against the second spring 12, causing the second movable valve 10 to move. Specifically, according to the present embodiment, the knob switch 14 is rotatably mounted on the outer housing 18, and a rotation shaft of the knob switch 14 is located in the cavity 32 of the outer housing 18, and a rotation handle of the knob switch 14 is arranged on the surface of the panel 31.

It can be understood that, with the above-mentioned configuration, the knob switch 14 can be linked with the first movable valve 9 and the second movable valve 10, respectively, under the transmission action of the shifting lever 15 and the butterfly plate 17, i.e. the movement of the first movable valve 9 and the second movable valve 10 can be controlled by the knob switch 14. When using the air pump, the first movable valve 9 and the second movable valve 10 can be alternately driven to respectively overcome the elastic force to move by controlling the forward and reverse rotation of the knob switch 14 outside the air pump, that is, the first movable valve 9 and the second movable valve 10 can be selectively driven as long as the rotation direction of the knob switch 14 is controlled, thus achieving inflation and deflation of the air pump device with convenient operation.

As shown in FIG. 13 to FIG. 16, the length directions of the shifting lever 15, the first spring 11 and the second spring 12 are all perpendicular to the rotation plane of the knob switch 14.

Figure 16:
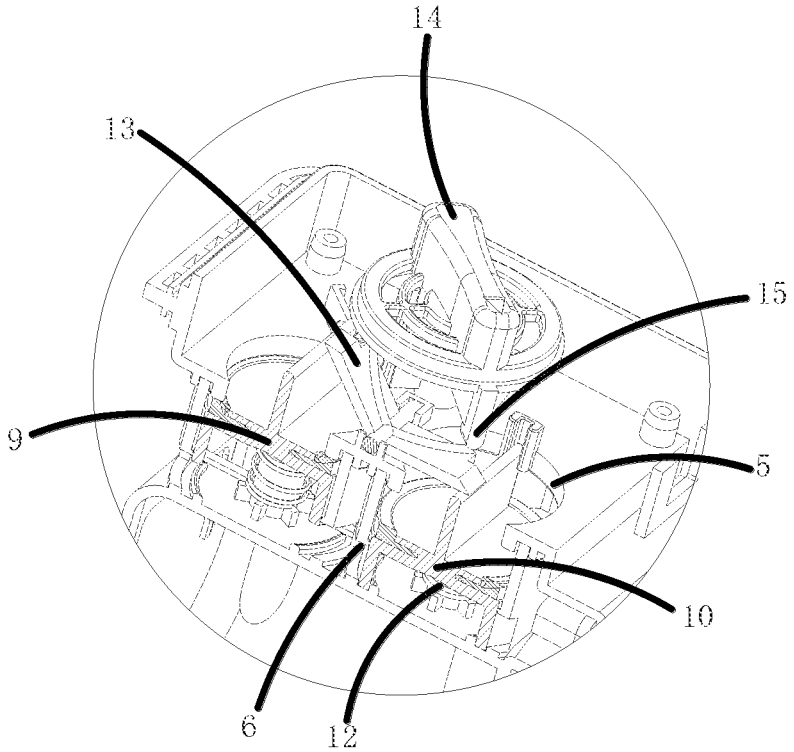
FIG. 16 is a schematic diagram of an internal structure of the present invention.

According to this embodiment, the length directions of the shifting lever 15, the first spring 11 and the second spring 12 are respectively perpendicular to the rotation plane of the knob switch 14, and the shifting lever 15 is formed to be parallel to the first spring 11 and the second spring 12 respectively. With such configuration, when the butterfly plate 17 is in a deflected state (clockwise or counterclockwise state), as shown in FIG. 15 or FIG. 16, the shifting lever 15 will reach the free end of the outer end of the butterfly plate 17, and exert a pushing force on the first spring 11 or the second spring 12 from the free end of the butterfly plate 17 to compress the spring, at this moment, the first spring 11 or the second spring 12 generates an opposite-direction acting force on the shifting lever Since the direction of the opposite-direction acting force is perpendicular to the rotation plane of the knob switch 14, the knob switch 14 cannot be pushed to rotate to reset. That is, after the knob switch 14 drives the shifting lever 15 to push the butterfly plate 17 to deflect, both the first spring 11 on the first movable valve 9 and the second spring 12 on the second movable valve 10 cannot reversely push the knob switch 14 to reset, the knob switch 14 thus can be self-locked. Therefore, the knob switch 14 needs to be manually controlled to rotate to reset, then the butterfly plate 17 can be pushed by the first spring 11 or the second spring 12 to reset. With such configuration, the air pump device thus can be automatically locked in the inflated state or the deflated state easily in convenient operation.

As shown in FIGS. 5-8, the first channel 2 and the second channel 3 are formed in the inner housing 19, and a first mounting sleeve 20 and a second mounting sleeve 21 are respectively formed in the inner housing 19. One end of the first mounting sleeve 20 abuts upward against and communicates with the first air hole 4, and the other end of the first mounting sleeve 20 abuts downward against and communicates with the first channel 2. The third air hole 7 is formed in the side wall of the first mounting sleeve 20. The first movable valve 9 is sleeved with the first mounting sleeve 20 in a sliding mode, so that the first air hole 4 and the third air hole 7 are alternately closed by the up-down linear reciprocating movement of the first movable valve 9 in the first mounting sleeve 20. On the other hand, one end of the second mounting sleeve 21 abuts upward against and communicates with the second air hole 5, and the other end of the second mounting sleeve 21 abuts downward against and communicates with the second channel 3. The fourth air hole 6 is formed in the side wall of the second mounting sleeve 21. The second movable valve 10 is sleeved with the second mounting sleeve 21 in a sliding mode so that the second air hole 5 and the fourth air hole 6 are alternately closed by the up-down linear reciprocating movement of the second movable valve 10 in the second mounting sleeve 21.

It can be understood that the first mounting sleeve 20 can limit the first movable valve 9 to move in a linear direction, and the second mounting sleeve 21 can limit the second movable valve 10 to move in a linear direction. With the above-mentioned configuration, it is possible to easily realize that the first air hole 4 and the third air hole 7 can be alternately closed by the first movable valve 9 in linear reciprocating movement, and it is also possible to easily realize that the second air hole 5 and the fourth air hole 6 can be alternately closed by the second movable valve 10 in linear reciprocating movement.

As shown in FIGS. 5-8 and 19, the inner housing 19 is provided with a first connecting hole 39 at a position corresponding to the bottom of the first mounting sleeve 20, and the first connecting hole 39 is in communication with the first channel 2 in the inner housing 19, so that the inside of the first mounting sleeve 20 can be communicated with the first channel 2 through the first connecting hole 39 for airflow circulating. Similarly, the inner housing 19 is provided with a second connecting hole 40 in the side wall of the first mounting sleeve 20, and the second connecting hole 40 is in communication with the second channel 3 in the inner housing 19, so that the inside of the second mounting sleeve 21 can be communicated with the second channel 3 through the second connecting hole 40.

Figure 17:
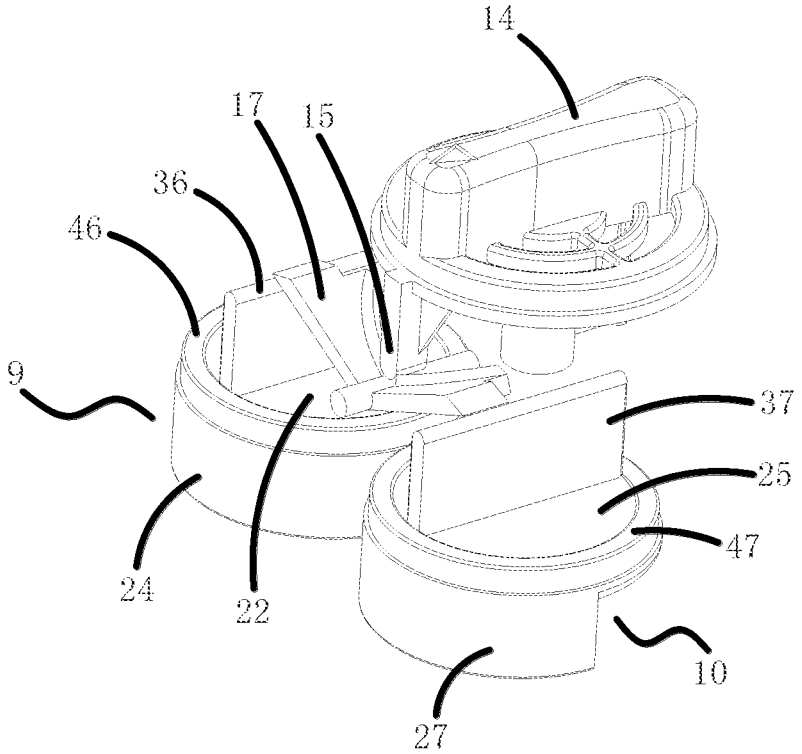
FIG. 17 is a schematic diagram of a partial structure of the present invention.
Figure 18:
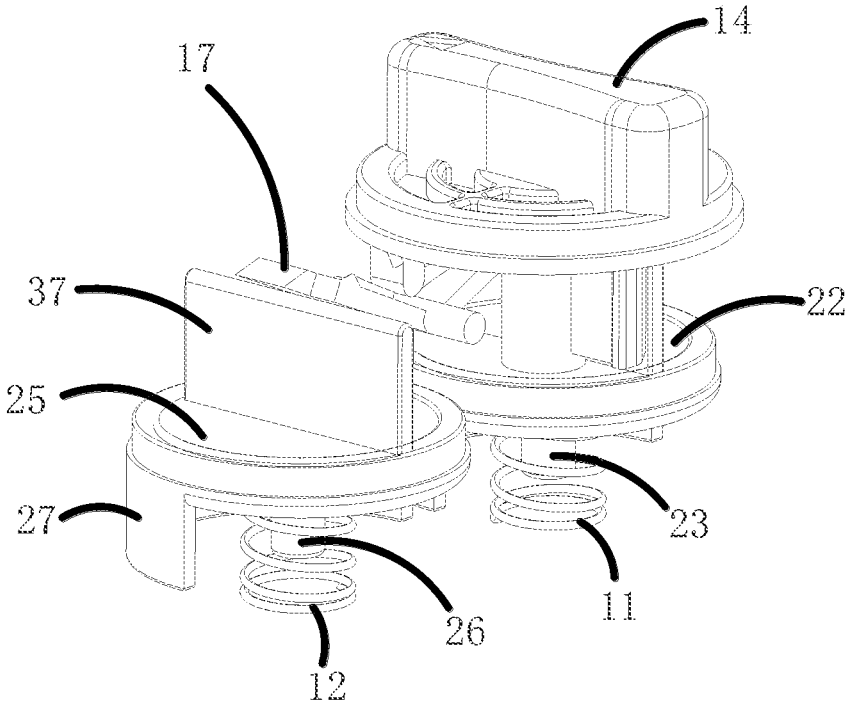
FIG. 18 is a schematic diagram of a partial structure of the present invention.

As shown in FIG. 17 and FIG. 18, the first movable valve 9 includes a first valve plate 22, a first spring bearing 23 and a first side valve plate 24. The first valve plate 22 is sleeved with the first mounting sleeve 20 in a sliding mode, the first spring bearing 23 is fixed to the bottom plate surface of the first valve plate 22 and located in the first mounting sleeve 20. The first side valve plate 24 may be integrally formed on the side edge of the first valve plate 22 and correspondingly on one side of the third air hole 7, and the first spring 11 is sleeved on the first spring bearing 23 and can elastically drive the first valve plate 22 to move upward to keep the first air hole 4 closed. In combination with FIG. 11, when the first valve plate 22 is driven to overcome the elastic force of the first spring 11 and move downward by the counterclockwise deflection of the butterfly plate 17, the first valve plate 22 opens the first air hole 4 and at the same time, the first side valve plate 24 is driven to close the third air hole 7. That is, it is possible to close the first air hole 4 when the first movable valve 9 moves upward, close the third air hole 7 when the first movable valve 9 moves downward, and alternately close the first air hole 4 and the third air hole 7 by linear movement of the first movable valve 9.

Similarly, the second movable valve 10 includes a second valve plate 25, a second spring bearing 26 and a second side valve plate 27. The second valve plate 25 is sleeved with the second mounting sleeve 21 in a sliding mode, the second spring bearing 26 is fixed to the bottom plate surface of the second valve plate 25 and located in the second mounting sleeve 21, the second side valve plate 27 may be integrally formed on the side edge of the second valve plate 25 and correspondingly on one side of the fourth air hole 6, and the second spring 12 is sleeved on the second spring bearing 26 and can elastically drive the second valve plate 25 to keep the second air hole 5 closed. In combination with FIG. 12, when the second valve plate 25 is driven to overcome the elastic force of the second spring 12 and move downward by the deflection of the butterfly plate 17, the second valve plate 25 will open the second air hole 5 and at the same time, the second side valve plate 27 is driven to close the fourth air hole 6. That is, it is possible to close the second air hole 5 when the second movable valve 10 moves upward, close the fourth air hole 6 when the second movable valve 10 moves downward, and alternately close the second air hole 5 and the fourth air hole 6 by linear movement of the second movable valve 10.

As shown in FIG. 17 and FIG. 18, a first sealing ring 46 and a second sealing ring 47 are respectively fixed on the top plate surfaces of the first valve plate 22 and the second valve plate 25, so that the first valve plate 22 can better seal the first air hole 4 by the first sealing ring 46, and the second valve plate 25 can better seal the second air hole 5 by the second sealing ring 47.

Figure 19:
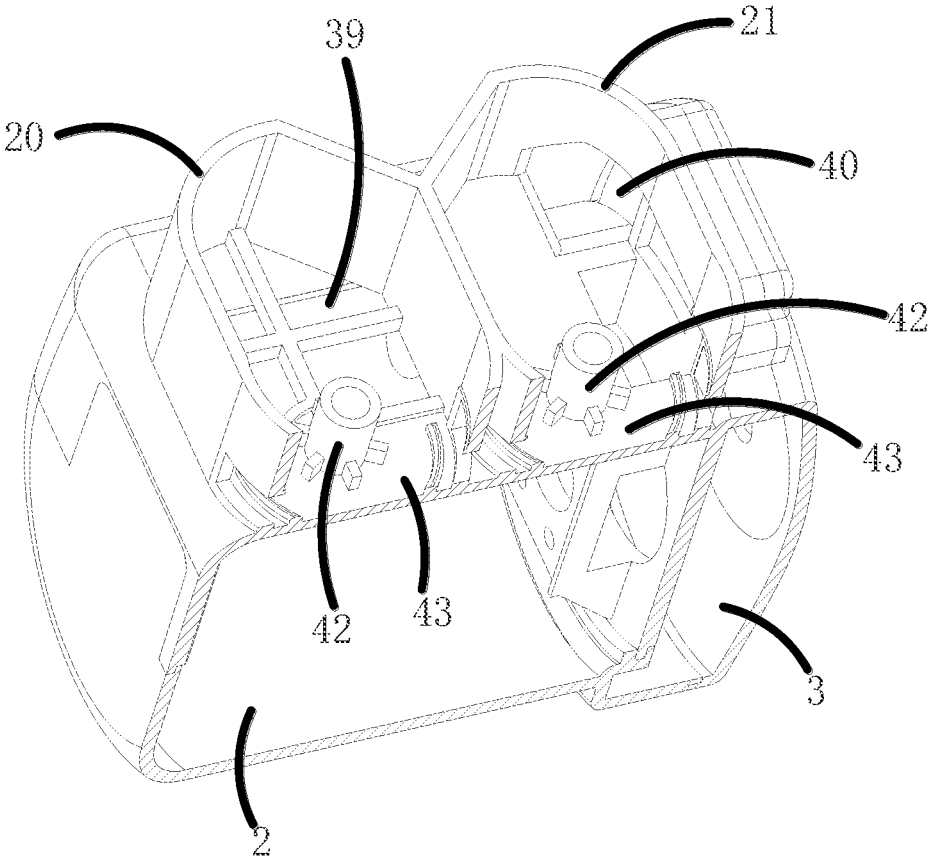
FIG. 19 is a schematic diagram of a partial structure of the present invention.

As shown in FIG. 19, a supporting plate 43 is fixedly formed at the bottom of each of the first mounting sleeve 20 and the second mounting sleeve 21, and a spring supporting cylinder 42 is integrally formed on the plate surface of each supporting plate 43. The lower ends of the first spring bearing 23 and the second spring bearing 26 are respectively sleeved with each spring supporting cylinder 42 so as to enable the first valve plate 22 and the second valve plate 25 to be stably assembled. The first spring 11 and the second spring 12 also respectively sleeve on the outside of each spring supporting cylinder 42 and also respectively abut against the plate surface of each supporting plate 43

Figure 20:
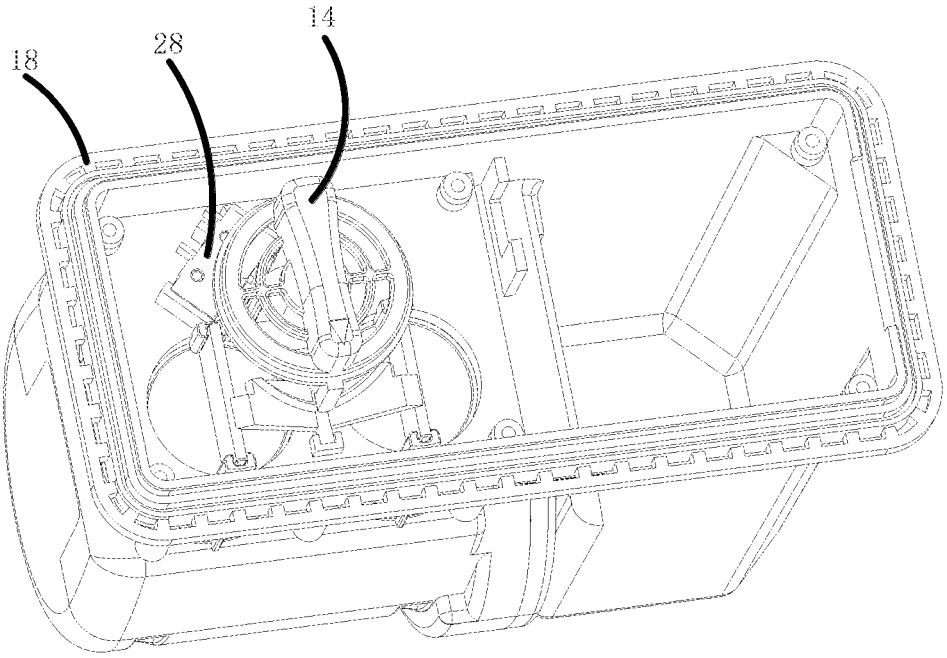
FIG. 20 is a schematic diagram of a partial structure of the present invention.
Figure 21:
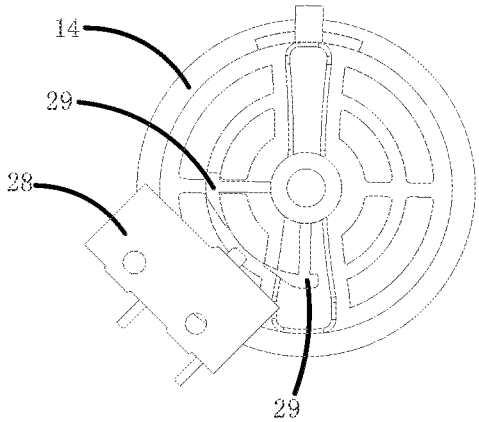
FIG. 21 is a schematic diagram of a partial structure of the present invention.
Figure 22:
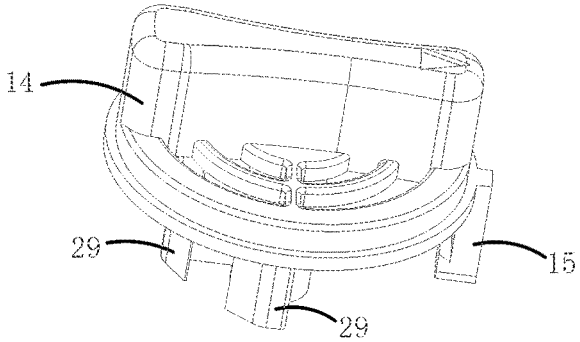
FIG. 22 is a schematic diagram of a partial structure of the present invention.

As shown in FIGS. 20-22, an electric control switch 28 is mounted in the outer housing 18, the knob switch 14 is hinged to the outer housing 18, at least two shifting plates 29 are fixed around the outer wall of a hinge shaft of the knob switch 14, and each shifting plate 29 can respectively touch the electric control switch 28 with the forward and reverse rotation of the knob switch 14 and synchronously trigger the electric control switch 28 to start the centrifugal fan 8. That is, whether the knob switch 14 rotates clockwise or counterclockwise, each shifting plate 29 can respectively touch the electric control switch 28 to trigger the electric control switch 28 to start rotation of the centrifugal fan 8.

It can be understood that the rotation of the knob switch 14 cannot only drive the shifting lever 15 to deflect the butterfly plate 17, but also can make each shifting plate 29 to synchronously trigger the electric control switch 28 to start the rotating motor 45 and drive the centrifugal fan 8, so that the inflation and deflation of the air pump device can be realized more easily.

As shown in FIG. 5 and FIG. 6, according to one embodiment, an accommodating cavity 30 for accommodating a power wire is integrally formed in the outer housing 18, which can accommodate with the power wire conveniently. Specifically, an opening of the accommodating cavity 30 is covered with a cover plate 38, and one side of the cover plate 38 is hinged to the outer housing 18, so that the accommodating cavity 30 can be opened or closed through the cover plate 38.

Figure 23:
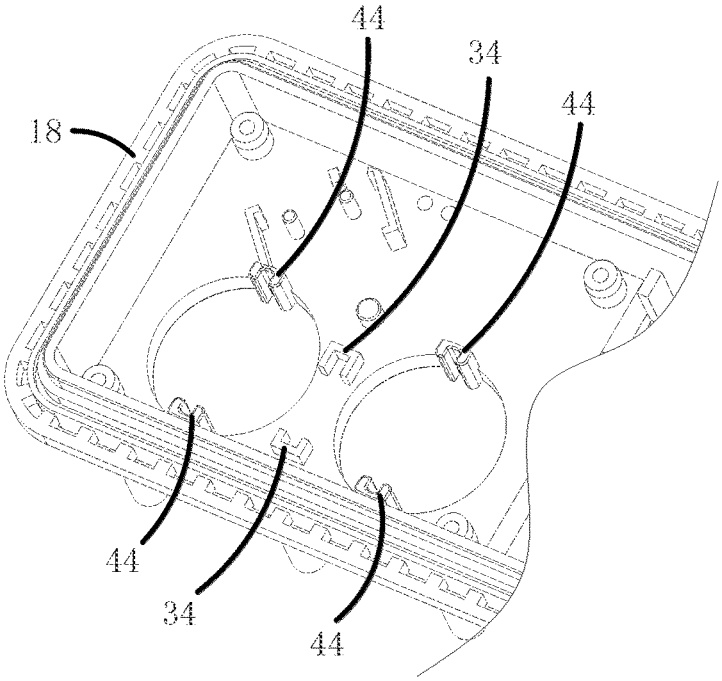
FIG. 23 is a schematic diagram of a partial structure of the present invention.

In combination with FIG. 23 and FIG. 14, two sleeving seats 34 opposite to each other and spaced at a certain distance are integrally formed in the outer housing 18, and the two ends of the central rotating shaft 16 in the middle of the butterfly plate 17 are respectively sleeved with the respective sleeving seats 34 in a sliding mode, so that rotatable arrangement of the butterfly plate 17 can be realized by hinge joint of the central rotating shaft 16.

As shown in FIG. 14, a rib 35 is formed on the surface of the butterfly plate 17, the cross section of the rib 35 is in form of triangle, the rib 35 extends in the swinging direction of the shifting lever 15, so that in the process that the shifting lever 15 rotates with the knob switch 14, the tail end of the shifting lever 15 abuts against the rib 35, and the shifting lever 15 exerts a pushing force on the butterfly plate 17 by abutting against the rib 35.

The rib 35 may be integrally formed on the surface of the butterfly plate 17, which means that a groove body corresponding to the rib 35 is also formed on a plastic mold for producing the butterfly plate 17. The cross section of the groove body is also in form of triangle, so that mold repairing can be facilitated, namely, by processing and adjusting the depth of the groove body, the height of the rib 35 can be adjusted, which ensures that the rib 35 inside the produced air pump device can abut against the shifting lever 15, and further ensure that the shifting lever 15 can push the butterfly plate 17, thus further beneficial to the production and assembly of air pump products.

Referring to FIGS. 17-18 and FIGS. 11-12, the first movable valve 9 and the second movable valve 10 further include a first transmission plate 36 and a second transmission plate 37, respectively. The first transmission plate 36 and the second transmission plate 37 may be integrally formed on the plate surfaces of the first valve plate 22 and the second valve plate 25, respectively. The upper end of the first transmission plate 36 and the upper end of the second transmission plate 37 can abut against the bottoms of the left and right ends of the butterfly plate 17, respectively.

The configuration that the first transmission plate 36 and the second transmission plate 37 are integrally formed on the surfaces of the first valve plate 22 and the second valve plate 25, respectively, means that groove bodies corresponding to the first transmission plate 36 and the second transmission plate 37 are respectively formed on the produced plastic mold, so that mold repairing can be facilitated. Namely, the height of the first transmission plate 36 or the second transmission plate 37 can be adjusted by processing and adjusting the depth of the groove body, which ensures that the first transmission plate 36 and the second transmission plate 37 inside the produced air pump device can always abut against the butterfly plate 17, and further ensures that the butterfly plate 17 can push the first valve plate 22 and the second valve plate 25, thus further beneficial to the production and assembly of the air pump products.

Referring to FIG. 23 and FIGS. 11, and 17-18, four guide rails 44 are integrally formed on the outer housing 18. Two guide rails 44 thereof are respectively in sleeved connection with the first transmission plate 36 on two opposite sides of the first transmission plate 36 in a sliding mode, and another two guide rails 44 are respectively in sleeved connection with the second transmission plate 37 on two opposite sides of the second transmission plate 37 in a sliding mode, so that the first transmission plate 36 and the second transmission plate 37 can move up and down more stably.

Based on the above mentioned, as shown in FIG. 1 to FIG. 23, the working principle of the present invention is as follows.

When inflation of the inflatable product 100 is required, the knob switch 14 is manually controlled to rotate clockwise, the shifting lever 15 is driven to swing and the butterfly plate 17 is pushed to deflect counterclockwise, and the first valve plate 22 is accordingly pushed to move downward, so that the first valve plate 22 opens the first air hole 4, and the first side valve plate 24 is driven to close the third air hole 7. Meanwhile, the centrifugal fan 8 is also rotated. Under the suction of the suction end of the centrifugal fan 8, the air outside enters the first air hole 4 through the through hole 33 in the panel 31, and then enter the first channel 2 inside the air pump through the first air hole 4, At the same time, under the pushing action of the exhaust end of the centrifugal fan 8, the air entering the first channel 2 can be pushed into the second channel 3, and as the airflow flows, the air in the second channel 3 can continuously enter the inner cavity of the inflatable product 100 through the fourth air hole 6, thus achieving inflation.

When inflation is completed, the knob switch 14 is reset and rotated to an intermediate position, the shifting plate 29 also synchronously leaves the electric control switch 28 to stop rotation of the centrifugal fan 8. At the same time, under the resetting pushing action of the first spring 11, the first valve plate 22 is pushed to reset and move upward, so that the first air hole 4 is re-closed. At this moment, the first air hole 4 and the second air hole 5 are both in a closed state, so that the first channel 2 and the second channel 3 inside the air pump cannot communicate with the outside, the entire air pump thus is in a closed state, ensuring that the air in the inner cavity of the inflatable product 100 cannot leak outwards, and the inflatable product 100 can be kept in the inflated state.

When deflation of the inflatable product 100 is required, the knob switch 14 is manually controlled to rotate counterclockwise, the shifting lever 15 is driven to swing and the butterfly plate 17 is pushed to deflect clockwise, and the second valve plate 25 is accordingly pushed to move downwards, so that the second valve plate 25 opens the second air hole 5, and the second side valve plate 27 is driven to close the fourth air hole 6. Meanwhile, the centrifugal fan 8 is also rotated, under the suction of the suction end of the centrifugal fan 8, the air in the inner cavity of the inflatable product can enter the first channel 2 inside the air pump via the third air hole 7. At the same time, under the pushing effect of the exhaust end of the centrifugal fan 8, the air entering the first channel 2 can be pushed into the second channel 3, and as the airflow flows, the air in the second channel 3 can continue to flow to the through hole 33 in the panel 31 through the second air hole 5, and is finally discharged to the outside through the through hole 33 in the panel 31, thus achieving deflation.

An inflatable product 100 including such built-in air pump is also provided according to an embodiment.

It should be explained that the above embodiments are only used to illustrate the technical solutions of the present invention, but not to limit them. Those of ordinary skill in the art should understand that they can still modify the technical solutions recorded in the foregoing embodiments, or equivalently replace some of the technical features; and these modifications or replacements do not make the essence of the corresponding technical solutions deviate from the spirit and scope of the technical solutions of the embodiments of the present invention.

The invention claimed is:

1. A built-in air pump for an inflatable product, comprising:

a first channel, a first air hole and a third air hole being formed in the first channel;

a second channel, a second air hole and a fourth air hole being formed in the second channel; and a centrifugal fan, a suction end of the centrifugal fan abutting against the first channel, and an exhaust end of the centrifugal fan abutting against the second channel, wherein the first air hole and the second air hole are configured to externally communicate with an outside of the inflatable product, and the third air hole and the fourth air hole are configured to internally communicate with an inner cavity of the inflatable product;

wherein the centrifugal fan is configured to start to operate, and the first air hole and the fourth air hole are configured to be opened and the second air hole and the third air hole are configured to be closed when inflation of the inflatable product is required, so that the air outside is sucked into the first channel through the first air hole by the centrifugal fan, and further pushed to the second channel and delivered to the inner cavity of the inflatable product through the fourth air hole by the centrifugal fan; the first air hole and the second air hole are further configured to be closed to prevent the air from leaking to the outside when inflation is completed, and wherein the centrifugal fan is configured to start to operate, and the third air hole and the second air hole are configured to be opened and the first air hole and the fourth air hole are configured to be closed when deflation of the inflatable product is required, so that the air in the inner cavity of the inflatable product is sucked into the first channel through the third air hole by the centrifugal fan, and further pushed into the second channel and discharged to the outside through the second air hole by the centrifugal fan;

further comprising a control mechanism and a valve mechanism, the valve mechanism being controlled by the control mechanism to open or close the first air hole, the second air hole, the third air hole and the fourth air hole, wherein the valve mechanism includes a first movable valve and a second movable valve which are respectively slidable in a mounting sleeve, each of the movable valve includes a valve plate, a spring bearing and a side valve plate, the valve plate is sleeved with the respective mounting sleeve in a sliding way, the spring bearing is fixed to a bottom of the valve plate and located in the respective mounting sleeve, the side valve plate of each movable valve is respectively located on one side of the third air hole and the fourth air hole, and a spring is sleeved on the spring bearing of each movable valve and is adapted to elastically drive the respective valve plate to move upward to keep the first air hole and the second air hole closed.

2. The built-in air pump according to claim 1, wherein the first air hole and the third air hole are alternately closed by reciprocating movement of the first movable valve, and the second air hole and the fourth air hole are alternately closed by reciprocating movement of the second movable valve.

3. The built-in air pump according to claim 2, wherein a rotating body is connected between the control mechanism and the valve mechanism in a transmission way, the rotating body is configured to be driven by the control mechanism to conduct forward and reverse rotation, and the first movable valve and the second movable valve are configured to respectively be driven to move with the forward and reverse rotation of the rotating body.

4. The built-in air pump according to claim 3, wherein the control mechanism comprises a knob switch and a shifting lever, the shifting lever is arranged on the knob switch and is rotatable with the knob switch, and the shifting lever is configured to shift the rotating body to conduct the forward and reverse rotation with rotation of the knob switch.

5. The built-in air pump according to claim 4, wherein the rotating body includes a central rotating shaft and a butterfly plate, the shifting lever is fixed to a bottom of the knob switch 14 and extends outwards to the butterfly plate.

6. The built-in air pump according to claim 1, wherein the built-in air pump has a housing, and the first channel and the second channel are spaced in the housing.

7. The built-in air pump according to claim 6, wherein the centrifugal fan and a rotating motor suppling power for the centrifugal fan are arranged in the first channel.

8. The built-in air pump according to claim 6, wherein an accommodating cavity for accommodating a power wire is formed in the housing.

9. The built-in air pump according to claim 8, wherein the accommodating cavity is covered with a cover plate which is hinged to the housing.

10. An inflatable product, which is provided with a built-in air pump, wherein the built-in air pump comprises:

a first channel, a first air hole and a third air hole being formed in the first channel;

a second channel, a second air hole and a fourth air hole being formed in the second channel;

a centrifugal fan, a suction end of the centrifugal fan abutting against the first channel, and an exhaust end of the centrifugal fan abutting against the second channel; and a housing, wherein the first channel and the second channel are formed in the housing, the housing has an outer housing and an inner housing which are detachably connected to each other, the outer housing is located on an outside of the inflatable product, and the inner housing is located on an inner cavity of the inflatable product, wherein the first air hole and the second air hole are configured to externally communicate with the outside of the inflatable product, and the third air hole and the fourth air hole are configured to internally communicate with the inner cavity of the inflatable product, the built-in air pump further comprises a control mechanism and a valve mechanism, wherein the control mechanism is arranged on the outer housing, a mounting sleeve is formed in the inner housing, the valve mechanism is slidable in the mounting sleeve, and the valve mechanism is controlled to move in the mounting sleeve to open or close the first air hole, the second air hole, the third air hole, and the fourth air hole by the control mechanism; and wherein the valve mechanism includes a first movable valve and a second movable valve, the mounting sleeve correspondingly includes a first mounting sleeve and a second mounting sleeve, each movable valve includes a valve plate, a spring bearing and a side valve plate, the valve plate is sleeved with the respective mounting sleeve in a sliding way, the spring bearing is fixed to a bottom of the valve plate and located in the respective mounting sleeve, the side valve plate of each movable valve is respectively located on one side of the third air hole and the fourth air hole, and a spring is sleeved on the spring bearing of each movable valve and is adapted to elastically drive the valve plate to move upward to keep the first air hole and the second air hole closed.

11. The inflatable product according to claim 10, wherein the first channel and the second channel are formed in the inner housing, the first air hole and the second air hole are formed in the outer housing and communicated with the outside of the inflatable product, and the fourth air hole and the third air hole are formed in the inner housing and communicated with the inner cavity of the inflatable product.

12. The inflatable product according to claim 10, wherein an outer surface of the outer housing is provided with a panel and a cavity is formed in the outer housing, a plurality of through holes are arranged in the panel, the first air hole and the second air hole are formed at the bottom of the cavity and communicated with the cavity.

13. The inflatable product according to claim 10, wherein a rotating body is connected between the control mechanism and the valve mechanism in a transmission way, the first movable valve and the second movable valve are oppositely distributed on the rotating body and abutted against the rotating body in a transmission way.

14. The inflatable product according to claim 13, wherein the control mechanism includes a knob switch and a shifting lever, the shifting lever is arranged on the knob switch and is rotatable with the knob switch, and the shifting lever is configured to shift the rotating body to conduct rotation with the knob switch.

15. The inflatable product according to claim 14, wherein the shifting lever and the spring are perpendicular to a rotation plane of the knob switch.

* * * * *